US005996237A

United States Patent [19]

Sanders

[11] Patent Number: 5,996,237

[45] Date of Patent: Dec. 7, 1999

[54] EDGE CUTTER TRIM TOOL

[75] Inventor: Donald D. Sanders, Greenville, N.C.

[73] Assignee: Sandco, Greenville, N.C.

[21] Appl. No.: 08/643,791

[22] Filed: May 6, 1996

[51] Int. Cl.[6] ..... B26B 29/06

[52] U.S. Cl. ..... 33/42; 33/32.2; 30/293

[58] Field of Search ..... 33/32.1, 32.2, 33/41.6, 26, 42, 43, 44, 526, 527; 30/286, 289, 290, 293, 294, 292

[56] References Cited

U.S. PATENT DOCUMENTS

| | | | |
|---|---|---|---|
| 368,854 | 8/1887 | Russell | 33/42 |
| 687,913 | 12/1901 | Bird | 33/44 |
| 1,445,546 | 2/1923 | Olson | 33/42 |
| 1,449,368 | 3/1923 | Anderson | 33/42 |
| 1,450,676 | 4/1923 | Wells et al. | 33/44 |
| 2,090,183 | 8/1937 | Capstick | 33/32.1 |
| 2,829,436 | 4/1958 | Leinwebber | 33/42 |
| 4,495,697 | 1/1985 | Ruff . | |
| 4,761,884 | 8/1988 | Nguyen et al. . | |
| 4,903,409 | 2/1990 | Kaplan et al. . | |
| 4,949,462 | 8/1990 | Spencer | 33/42 |
| 4,977,673 | 12/1990 | Altizer | 30/294 |
| 5,309,642 | 5/1994 | McGinnis | 33/42 |
| 5,353,508 | 10/1994 | Baker | 33/42 |

*Primary Examiner*—Thomas B. Will
*Attorney, Agent, or Firm*—Steven J. Hultquist

[57] ABSTRACT

A cutter device comprising: a rigid rectangular support frame, including an elongate guide bar for positioning the frame at the edge of a web article; a transversely extending slide bar joined to and extending across a midportion of the rigid rectangular support frame, secured to the elongate guide bar; and a knife holder assembly which is transversely slidable on the transversely extending slide bar. The knife holder assembly comprises a main body member which is transversely slidable on the transversely extending slide bar, and which may be locked in a selected transverse position, with a knife blade secured on the main body member for engagement with a transversely inward region of the web article. By such arrangement, the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

18 Claims, 4 Drawing Sheets

EDGE CUTTER TRIM TOOL

BACKGROUND OF THE INVENTION

1. Field of the Invention

The present invention relates to an edge cutter trim tool having utility for forming a cut seam edge on a web of carpet, vinyl tile, or other sheet form material.

2. Description of the Related Art

In the installation of carpet, vinyl tile, roofing membrane, and other web materials, the original stock material typically is in the form of a web article of a standard width or a series of manufactured widths, as well as standard length(s).

Accordingly, in use, these web materials must be selectively trimmed, to provide a surface area (areal extent) adapted to the dimensions of a physical space or structure to which the web material is to be applied. There have been numerous edge trimmer articles and seam cutter devices proposed in the art, but all are characterizable by deficiencies in respect of their cost, complexity, ease of manufacture and ease of use.

U.S. Pat. No. 5,353,508 issued Oct. 11, 1994 to David H. Baker discloses a border cutter for use with a cutter blade carrier for cutting a strip of carpet, the carrier having a blade plate for a cutting blade, the border cutter including a surface plate for movement along a piece of carpet, and having a guide edge and a cutting blade opening normal to the guide edge, and having spaced guides with aligned slots for receiving the carrier plate for positioning a blade at the blade opening. The spaced guides extend parallel to the blade opening, with each guide having a plurality of slots extending therealong in alignment with the slots of the other guide, providing a plurality of locations on the surface plate for the blade carrier. One of the spaced guides includes a channel for receiving a guide toe plate of a blade carrier support of the blade carrier.

U.S. Pat. No. 4,977,673 issued Dec. 18, 1990 to Eugene E. Altizer describes an apparatus for cutting a roofing membrane including a frame, means coupled to the frame for facilitating movement of the frame over a roofing membrane, a blade coupled to the frame for cutting the roofing membrane, and a guide member coupled to the frame for guiding the frame over the membrane. The guide member may include an edge guide and a bar coupling the edge guide to the frame. The edge guide is adapted to cooperate with an edge of the roofing membrane to move the frame along and parallel to the edge of the membrane. The guide member may be adjustable to permit the edge guide to be moved relative to the blade.

U.S. Pat. No. 4,495,697 issued Jan. 29, 1985 to Stanley Ruff discloses a plasterboard trimming tool consisting of two parallel arms interconnected by a web and having lateral guiding surfaces which face one another and confine the marginal portion of the plasterboard between themselves in operation. A transverse guide surface is provided in the web and a pair of cutting blades is mounted in respective holders at the same distance from the transverse guiding surface, the cutting blades having respective cutting edges which partially penetrate into the plasterboard to form continuous straight scoring cuts therein across the plasterboard from one another.

U.S. Pat. No. 4,761,884 issued Aug. 9, 1988 to Peter D. Nguyen, et al., describes a metal skin cutting device which cuts an edge of a first metal skin to a net shape that is complementary to the edge of a second metal skin that has been previously attached to a frame, such as the airframe of an aircraft fuselage. A guide carried by the device is adjustable to set the gap that will appear between the edges of the first and second metal skins when they are attached as by riveting to the airframe.

U.S. Pat. No. 4.903,409 issued Feb. 27, 1990 to Stuart N. Kaplan, et al. discloses a drywall scribing and scoring tool for a typical wallboard, comprising a knife holding unit and scribe units which can be adjusted along a scale on an elongated arm of a T-square member. When the short head portion of the T-square member is slid along one edge of the wall board by a person the tool will cut a score into the wall board for breaking the wall board to a predetermined size.

It therefore is an object of the present invention to provide an improved edge cutter trim tool which is usefully employed for cutting webs of carpet, vinyl tile, or other sheet form material.

Other objects and advantages of the present invention are more fully apparent from the ensuing disclosure and appended claims.

SUMMARY OF THE INVENTION

The present invention relates to an edge cutter trim tool having utility for cutting webs of carpet, vinyl tile, and other sheet form materials.

In one aspect, the present invention relates to a cutter device comprising: a rigid rectangular support frame, including an elongate guide bar for positioning the frame at the edge of a web article; a transversely extending slide bar joined to and extending across a midportion of the rigid rectangular support frame, being secured to the elongate guide bar; and a knife holder assembly which is transversely slidable on the transversely extending slide bar. The knife holder assembly comprises a main body member which is transversely slidable on the transversely extending slide bar, means for locking the main body member of the knife holder assembly in a selected transverse position, and means for securing a knife blade on the main body member for engagement with a transversely inward region of the web article. By such construction and arrangement, the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

In a preferred aspect of the cutter device broadly described above, the transversely extending slide bar is vertically adjustably secured to the elongate guide bar, thereby permitting the cutter device to accommodate a wide variety of thicknesses of web materials.

The blade holder assembly of the cutter device broadly described above may illustratively comprise a main body portion having pivotally mounted thereon a thumb lever, a biasing means for biasedly positioning the thumb lever in a position compressively retaining the knife blade in a selected position, and the thumb lever being manually translatable to release the knife blade from compressive retention by the thumb lever so that the knife blade is selectively manually moveable to a desired position.

Such blade holder assembly advantageously comprises a channel structure in which the knife blade is (I) compressively retained by the thumb lever in the selected position when the thumb lever is biasedly positioned, and (II) slidably selectively moveable when the thumb lever is manually translated to release the knife blade from the compressive retention thereof.

The slide bar of the cutter device in one embodiment thereof comprises a transversely extending slot opening therethrough with a mechanical fastener engaging the slot and coupling the blade holder assembly to the slide bar. The slide bar preferably comprises a frontal web-engaging surface portion on a bottom frontal part thereof, and a rear web-engaging surface portion on a bottom rear part thereof. The rear top surface of the slide bar may usefully feature a width indicating means, such as a ruler or width indicia.

In the aforementioned cutter device, the rectangular frame may comprise a front transversely extending stabilizer bar and a rear transversely extending stabilizer bar, longitudinally spaced from and in parallel relationship to one another. In another aspect, the rectangular frame comprises a ride bar having a height which is less than the height of the guide bar, transversely spaced from and parallel to the guide bar.

In another embodiment of the cutter device, the guide bar and ride bar each comprise a vertically upwardly extending elongate plate member, and the rectangular frame comprises a front transversely extending stabilizer bar and a rear transversely extending stabilizer bar, longitudinally paced from and in parallel relationship to one another, wherein each of the front and rear transversely extending stabilizer bars comprises an elongate cylindrical member.

In another aspect, the invention relates to a web cutting kit, including:

(A) a cutter de vice comprising:

a rigid rectangular support frame, including an elongate guide bar for positioning the frame at the edge of a web article;

a plurality of transversely extending slide bars, each of which is alternatively joinable to the elongate guide bar so as to extend across a midportion of the rigid rectangular support frame, and comprising slide bars of varying length;

mechanical fasteners for disassembleably interconnecting the frame members including such guide bar and one of the aforementioned transversely extending slide bars; and a knife holder assembly which is transversely slidable on the transversely extending slide bar, such knife holder assembly comprising a main body member which is transversely slidable on the transversely extending slide bar, means for locking the main body member of the knife holder assembly in a selected transverse position, and means for securing a knife blade on the main body member for engagement with a transversely inward region of the web article, whereby the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

Such web cutting kit may further comprise an extension member fixedly securable to the frame member, wherein the extension member comprises an elongate extension arm with a series of longitudinally spaced-apart openings therein for pivotally securing the extension arm for rotation, whereby the cutter device is able to be translated along an arcuate travel path for cutting of a web in a non-linear cut profile.

In yet another aspect, the invention relates to a cutter device comprising:

a rigid rectangular support frame, including an elongate guide bar for positioning the frame at the edge of a web article, a ride bar having a height which is less than the height of the guide bar, transversely spaced from and parallel to the guide bar, a front transversely extending stabilizer bar having first and second ends joined to the guide bar and ride bar, respectively, and a rear transversely extending stabilizer bar, having first and second ends joined to the guide bar and ride bar, respectively, longitudinally spaced from and in parallel relationship to one another;

a transversely extending slide bar joined to and extending across a midportion of the rigid rectangular support frame, having first and second ends joined to the guide bar and ride bar, respectively; and a knife holder assembly which is transversely slidable on the transversely extending slide bar, said knife holder assembly comprising a main body member which is transversely slidable on the transversely extending slide bar, means for locking the main body member of the knife holder assembly in a selected transverse position, and means for securing a knife blade on the main body member for engagement with a transversely inward region of the web article, wherein the blade holder assembly comprises a main body portion having pivotally mounted thereon a thumb lever, a biasing means for biasedly positioning the thumb lever in a position compressively retaining the knife blade in a selected position, and the thumb lever being manually translatable to release the knife blade from compressive retention by the thumb lever so that the knife blade is selectively manually moveable to a desired position, wherein the blade holder assembly comprises a channel structure in which said knife blade is (I) compressively retained by the thumb lever in the selected position when the thumb lever is biasedly positioned, and (II) slidably selectively moveable when the thumb lever is manually translated to release the knife blade from said compressive retention thereof, and wherein the slide bar comprise a transversely extending slot opening therethrough with a mechanical fastener engaging the slot and coupling the blade holder assembly to the slide bar, whereby the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

Other aspects and features of the invention will be more fully apparent from the ensuing disclosure and appended claims.

DETAILED DESCRIPTION OF THE INVENTION AND PREFERRED EMBODIMENTS THEREOF

Figure 1:
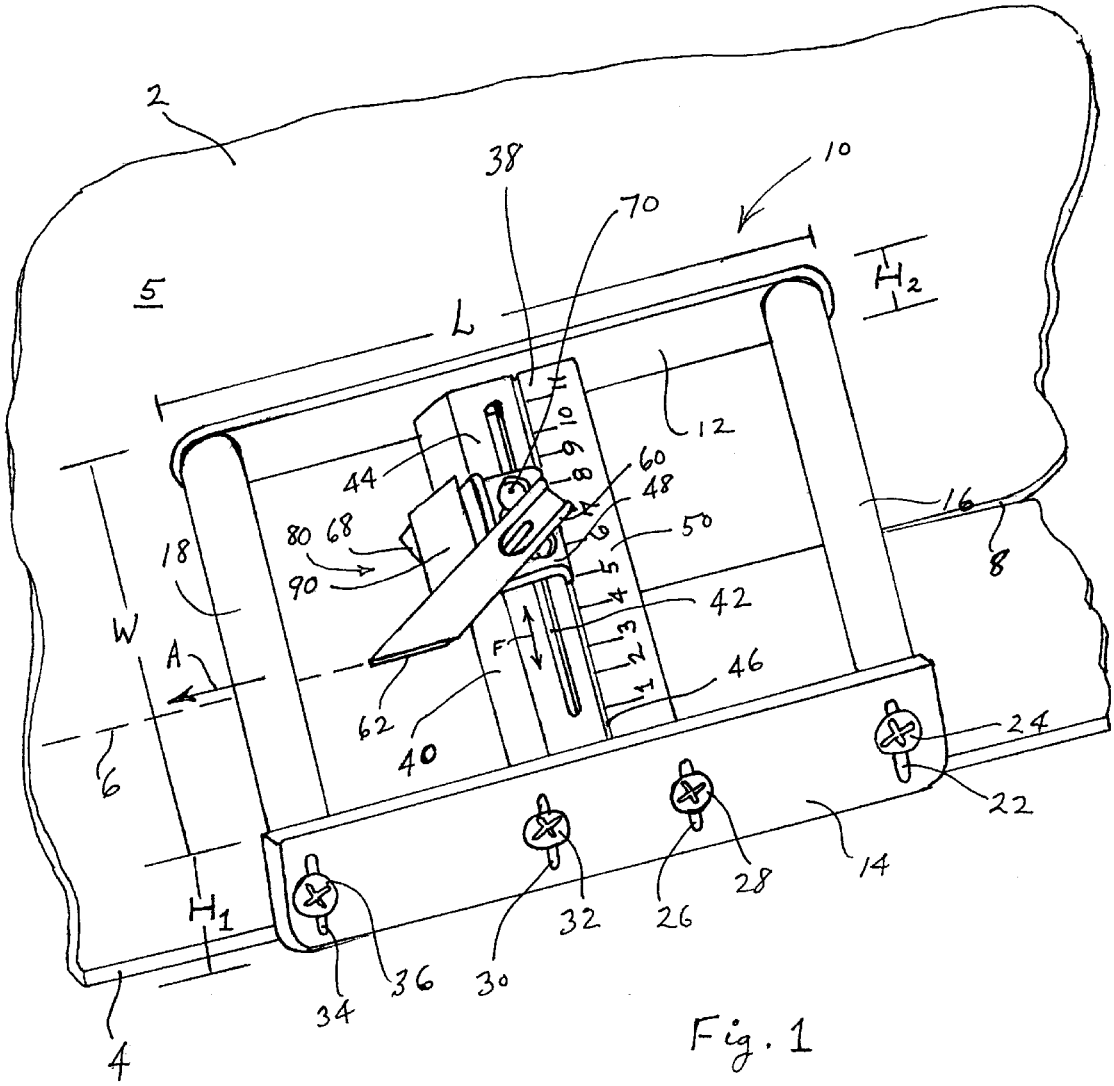
FIG. 1 is a perspective view of a cutter device according to one embodiment of the present invention.

Referring now to the drawings, a cutter device according to one embodiment of the invention is shown in FIGS. 1–5.

Figure 2:
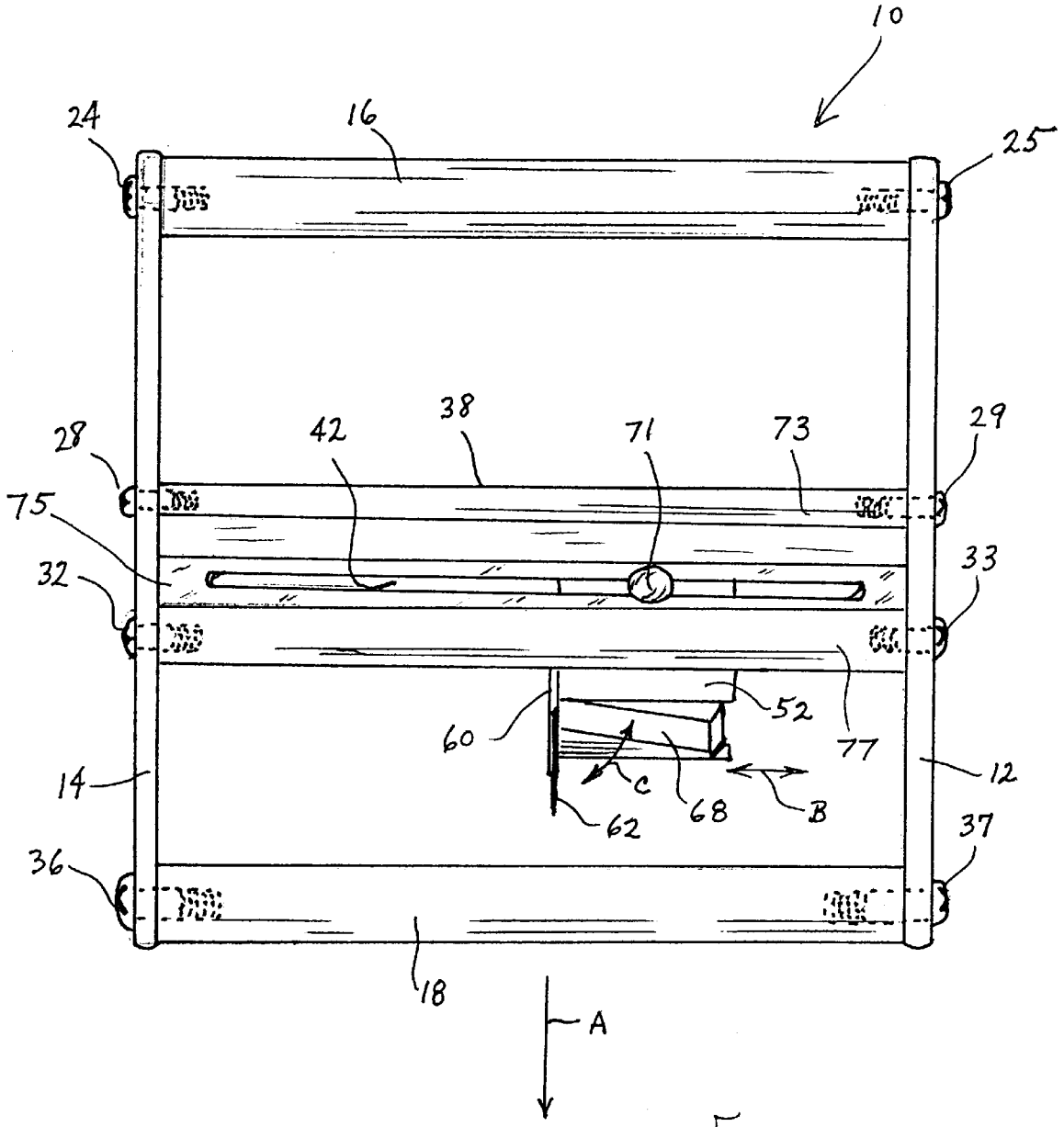
FIG. 2 is bottom plan view of the cutter device of FIG. 1.

FIG. 1 is a perspective view of a cutter device 10 according to one embodiment of the present invention, with a bottom plan view of the device being shown in FIG. 2. The cutter device comprises a rectangular frame assembly including a front stabilizer bar 18, a rear stabilizer bar 16, and a slide bar 38, each of which extends transversely, preferably perpendicularly, to the longitudinally extending guide bar 14 and longitudinally extending ride bar 12.

Thus, the guide bar 14 and longitudinally extending ride bar 12 are in transversely spaced-apart and parallel relationship to one another, being spaced apart by a distance W as shown in FIG. 1. The length dimension of each of the elongate guide bar 14 and ride bar 12 elements is L as shown in FIG. 1. The height of the ride bar 12 as shown in FIG. 1 is $H_2$ and the height of the guide bar 14 is $H_1$, with $H_1$ being of larger dimension than $H_2$ (i.e., $H_1>H_2$).

The rear and front stabilizer bars 16 and 18 are shown as being of cylindrical form, with a circular cross-section as measured in the longitudinal direction parallel to each of the respective guide and ride bars 14 and 12. The stabilizer bars may have any other suitable shape, form or cross-section that is desired or appropriate to the contemplated specific end use of the device, however, it is preferred that the stabilizer bars have a circular, oval or other curvate cross-sectional profile, to facilitate the ready sliding movement of the frame of the cutter device along the top surface of the web being cut by the device.

Each of the front stabilizer bar 18, rear stabilizer bar 16, and slide bar 38 is detachably fastened at its respective ends to the longitudinally extending guide bar 14 and longitudinally extending ride bar 12, by means of suitable mechanical fastener elements such as the screws 24, 25, 36 and 37 shown in FIG. 2, with the stabilizer bars 16 and 18 as shown in FIG. 2 being correspondingly tapped and interiorly threaded, to threadably receive the screws therein. It will be appreciated that other mechanical fastener elements and assemblies may be usefully employed in the broad practice of the invention to secure the stabilizer bars to the guide bar 14, ride bar 12, and slide bar 38. Examples of alternative mechanical fasteners include threaded rods protruding thorough openings in the guide bar and ride bar, and receiving lock nut, wing nut of other cooperatively mating threaded elements. As a still further alternative, frame may be assembled with the guide and ride bars being secured to the stabilizer bars and the slide bar by means of clamp, hook, latch, compression-lock, twist-lock, spring-biased detent, or other coupling means known in the art for securing mechanical and structural parts in fixed positional relationship to one another.

The guide bar 14 as shown in FIG. 1 is provided with vertical extending slots 22, 26, 30 and 34 for vertical adjustment of the guide bar in relation to the stabilizer bars 16 and 18 and the slide bar 38. For vertical adjustment, the screws 24, 28, 32 and 36 are unscrewed from their tightened states and the guide bar is selectively vertically positioned at a desired elevation, following which the screws 24, 28, 32 and 36 are retightened. Vertical adjustability of the guide bar permits the cutter device to accommodate various thicknesses of webs to be cut.

As shown in FIG. 1, the guide bar 14 overhangs bearingly against the edge 4 of the web 2 to be cut, so that the lower inside surface of the guide bar is in abutting contact with the surface of the edge 4. In such position, the frame of the cutter contacts the web with the stabilizer bars 16 and 18 and the bottom of the ride bar 12, as well as the front bearing surface 73 and rear bearing surface 77 (see FIGS. 2 and 3) of the slide bar 38, being in contact with the top surface 5 of the web 2 to be cut.

The height $H_2$ of the ride bar in the embodiment illustrated in FIG. 1 is equal to the diameter of each of the stabilizer bars 16 and 18, to facilitate the aforementioned contact with the top surface 5 of the web 2. It will be recognized that the height of the ride bar may be widely varied, as may the other dimensions of the frame and other elements of the cutter device, in the broad practice of the present invention. Nonetheless, the ride bar and the stabilizer bars preferably are constructed and arranged so that each is in bearing contact with the web top surface during the cutting operation, together with the aforementioned bearing surfaces of the slide bar, for the purpose of achieving extended area engagement of the frame with the web to ensure smooth cutting in use of the device of the invention, although the frame may otherwise be constructed.

Figure 3:
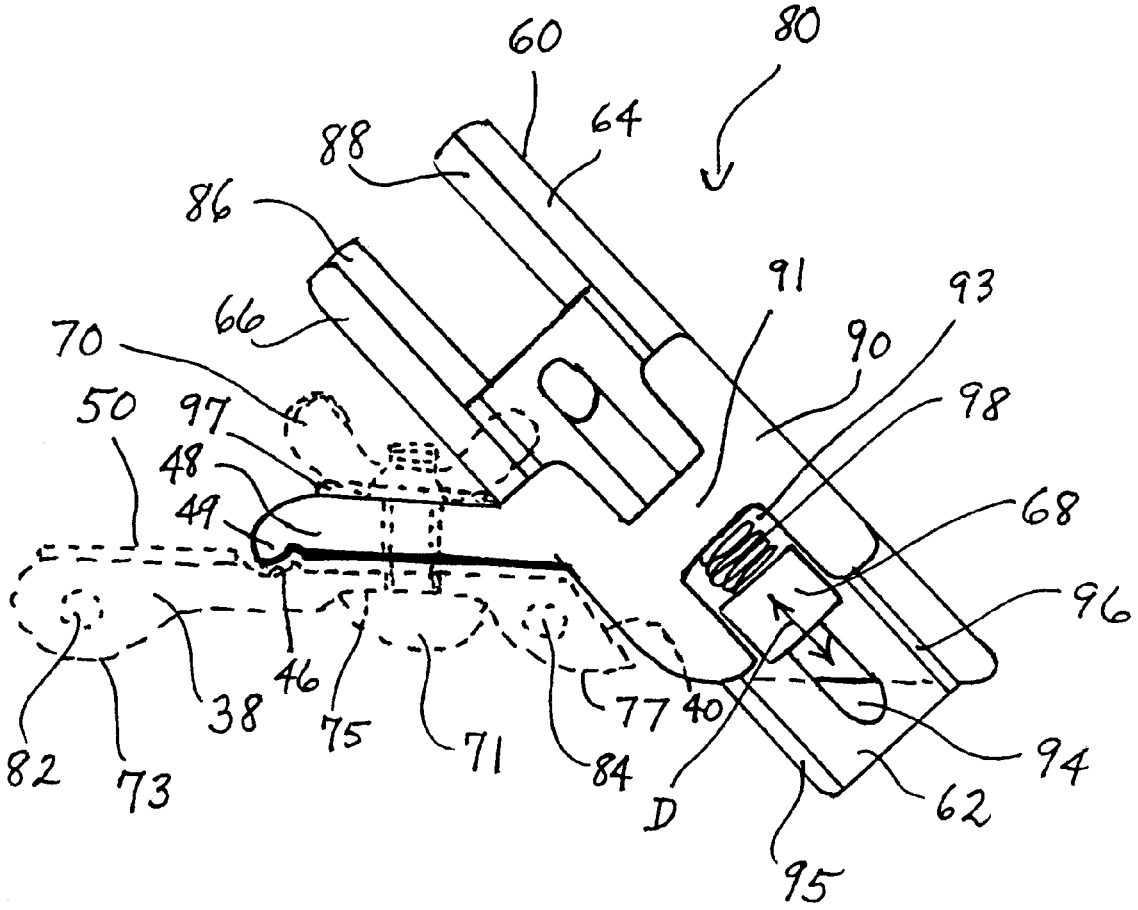
FIG. 3 is a side elevation view of the blade holder assembly of the FIG. 1 cutter device, with the blade holder assembly being shown coupled to the slide bar (in dotted line cross-section).

The slide bar 38 is coupled to the guide bar 14 and ride bar 12 and the respective ends of the slide bar, as for example by means of the screws 28, 29, 32 and 33 shown in FIG. 2 and received in complementarily threaded bore openings (e.g., bore openings 82 and 84 as shown in FIG. 3) in the body of the slide bar. The main body portion 44 of the slide bar has an elongate transverse slot 42 extending therethrough in which a bolt 71 (see FIGS. 2 and 3) is engaged with a washer 97 and wing nut 70 to secure the flange portion 48 of the blade holder assembly 80 to the slider bar.

The main body portion 44 of the slide bar has a downwardly and forwardly flat sloping surface 40 against which the main body portion 90 of the blade holder assembly 80 is bearingly reposed, and secured in position by the aforementioned bolt 71, washer 97 and wing nut 70. On the top rear portion of the slider bar 38 is disposed a ruler element 50 having width dimensions marked thereon for selecting the width of the edge portion of the web 2 to be cut off in use of the cutter device.

The main body portion 90 of the blade holder assembly 80 has affixed thereto , e.g., by welding, brazing, mechanical fastening, or integral unitary construction, a blade mount 60, the details of which are best shown in FIGS. 1 and 3. The main body portion 90 of the blade holder assembly 80 as shown in the FIG. 3 embodiment, has a generally H-shape in side view, with a rearwardly extending flange 48. The flange 48 is contoured on its rearward extremity with a downwardly extending leg 49 reposed in transverse groove 46 in the main body potion 44 of the slider bar 38.

The blade mount 60 includes marginal track portions 64 and 66 of increased thickness relative to the inner guide portions 86 and 88 which form a rail or channel structure for the cutting blade 62. The cutting blade 62 is illustratively of double-sided character with cutting edges 95 and 96 and central elongate opening 94 along the central portion of the blade. It will be recognized that the blade 62 may be of any suitable type, and may be varied widely in the broad practice of the present invention, including single-edge razor blades, double-edge razor blade, stiletto knife blades of single- or double-edge character, etc.

The blade 62 is selectively adjustable in the directions indicated by bi-directional arrow D in FIG. 3, by selective manual compression of the thumb lever 68 toward the yoke 91 of the main body portion 90 of the blade holder assembly 80.

The thumb lever is pivotally mounted in the cavity 93 between the lower legs of the main body portion 90, and spring-biased by spring element 98 toward the outer position shown in FIG. 3. In such spring-biased outer position, the thumb lever compressively retains the blade in position in the channel defined by the marginal track portions 64 and 66 and the inner guide portions 86 and 88.

When the thumb lever 68 is manually urged toward the yoke 91 of the main body portion 90, with compression of the biasing spring 98, the thumb lever disengages from the blade 62 and allows the blade to be selectively moved in either of the directions indicated by bi-directional arrow D, to thereby selectively extend or retract the blade, as desired.

The blade can therefore be extended as shown in FIG. 3 with the thumb lever compressed, and then the blade can be locked in position by the simple expedient of releasing the thumb lever. Contemporaneously, the blade holder assembly 80 can be selectively positioned, by loosening of the wing nut 70 and manually moving the blade holder assembley in one of the two opposite directions indicated by bi-directional arrow F in FIG. 1, followed by retightening of the wing nut 70 against the bolt 71.

With the blade holder assembly 80 in the desired position and with the blade 62 extended to the desired cutting depth, the frame of the cutting device is placed on the web as shown in FIG. 1, with the guide bar overhanging the edge 4 of the web, and the lower inside surface of the guide bar in abutting contact with the web edge. The frame of the device is then manually grasped in any convenient manner, e.g., with the respective hands grasping the ride bar 12 and the guide bar 14, and forwardly translated in the direction indicated by arrow A in FIG. 1, so that the blade is advanced along the path indicated in FIG. 1 by dashed line 6. In this manner, the cutter device severs the web 2 along the path of the blade 62, producing the desired cut edge 8 as shown in FIG. 1.

In such manner, the web 2, e.g., a carpet, carpet pad, vinyl flooring, roofing membrane, or other web material, is readily cut to any desired width along the slide bar 38, by selective adjustment of the blade holder assembly comprising blade 62 (the blade holder being moveable in either of opposite directions indicated by bi-directional arrow F in FIG. 1 and bi-directional arrow B in FIG. 2).

Further, by selective adjustment of the guide bar by appropriate adjustment and positioning of the screws 24, 28, 32 and 34, the height of the guide bar relative to the stabilizer bars and the slider bar can be set, and the disengagement and reengagement of the thumb lever 68, which is pivotally moveable in either of opposing directions indicated by bi-directional arrow C in FIG. 2, can be effected to provide a selected extent of blade exposure in relation to the blade holder, to accommodate any of a variety of web materials of varying thickness, including outdoor carpet, thick non-woven felts, foam sheets, deep pile carpet, carpet pads, etc.

Figure 4:
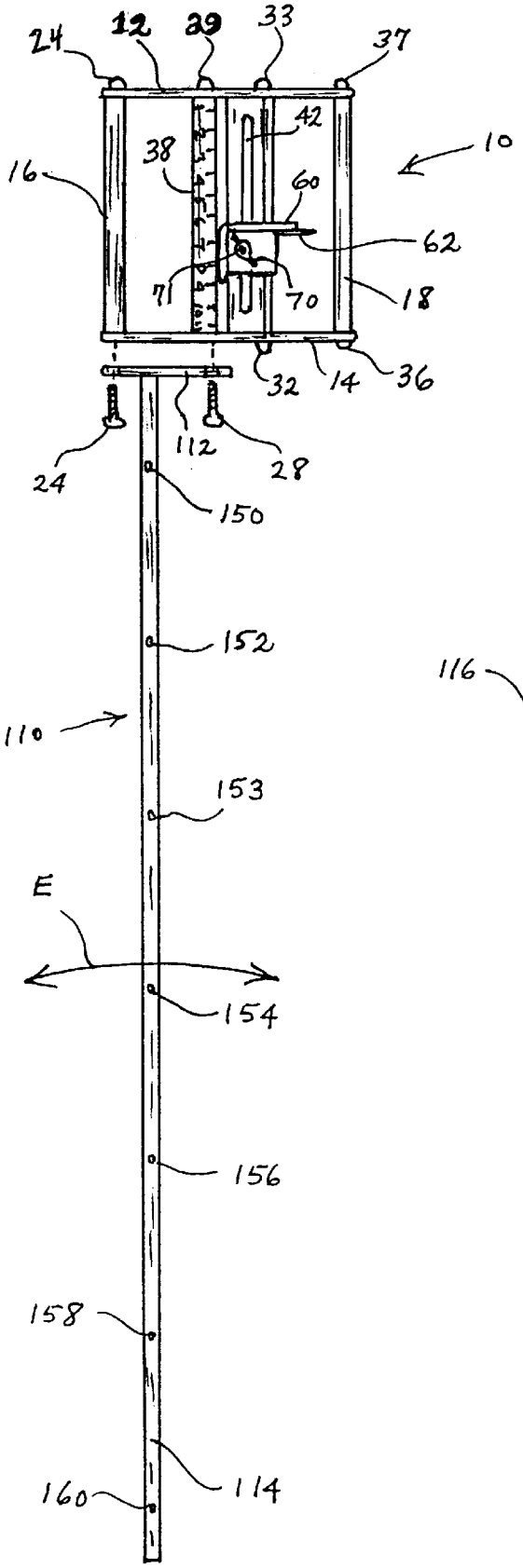
FIG. 4 is a top plan view of the cutter device of FIG. 1 as coupled with a circular cutting extension bar, such as may be used to cut circular and oval rugs.

FIG. 4 is a top plan view of the cutter device 10 of FIG. 1 as coupled with a circular cutting extension member 110, such as may be used to cut circular and oval rugs. For ease of description, corresponding elements of the cutter device to those shown in FIGS. 1–3 are correspondingly numbered.

As shown in the partially exploded view of FIG. 4, the screws 24 and 28 respectively coupling the guide bar to the stabilizer bar 16 and the slide bar 38 are additionally inserted through openings in mounting plate 112 so that the mounting plate flush mounts against the guide bar 14. Perpendicularly extending from the mounting plate 112 is an extension bar 114 of elongate flat form, which is provided with a series of openings 150, 152, 153, 154, 156, 158, and 160 therethrough along the length of the extension bar.

When flush mounted against the guide bar 14, the mounting plate 112 positions the bottom surface of the extension bar 114 (i.e., the main surface side which is opposite that shown in the top plan view of FIG. 4) so that it is in contact with the top surface of the web to be cut. Next, a nail, screw, rod or other positioning means may be extended through one of the openings 150, 152, 153, 154, 156, 158, and 160 along the length of the extension bar, and the cutter device 10 may then be translated along an arc, e.g., the arc denoted by the bi-directional arrow E in FIG. 4, or other arc depending on the "pinning" of the extension bar 114 by appropriate choice of the pivot point corresponding to a selected one of the openings in the extension bar, so that the cutter device in describing an appertaining arc of rotation effects a corresponding circular profile cut of the web being selectively trimmed to the desired shape.

In like manner, other extension members and arrangements may be employed with the cutter device 10, to provide cutting profiles of a widely varying character, including circular, oval, elliptical, and other curvate or non-linear shapes.

Figure 5:
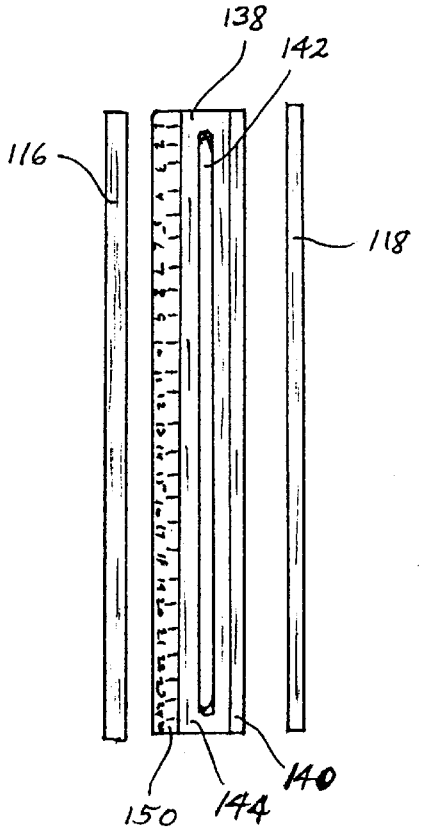
FIG. 5 is a top plan view of an assembly of extension stabilizer bars and slide bar, which may be extend the cutting distance from the guide bar, by substitution for the corresponding stabilizer bar and slide bar elements of the cutter device as shown in FIGS. 1–4.

FIG. 5 is a top plan view of an assembly of extension stabilizer bars and slide bar, which may be extend the cutting distance from the guide bar, by substitution for the corresponding stabilizer bar and slide bar elements (16, 18, and 38) of the cutter device 10 as shown in FIGS. 1–4. For ease of reference, the stabilizer bar and slider bar elements in FIG. 5 have been numbered correspondingly to the corresponding stabilizer bar and slider bar elements in FIGS. 1–4, by addition of 100 to the reference numerals of the corresponding elements of such earlier described Figures.

By such substitution of the stabilizer bar and slider bar elements of the FIG. 5 "kit" of such elements, the range of widths of cut edges can be substantially increased, to accommodate webs involving edge trim widths of widely divergent sizes. Thus, the extension member shown in FIG. 4 may be packaged with the basic cutter device 10 shown in FIGS. 1–4, together with the "high reach" stabilizer bars and slider bar shown in FIG. 5, as a combination kit of structural components permitting the edge trimming of a wide variety of web materials.

Although the invention has been described herein with reference to various illustrative embodiments and features, it will be appreciated that the invention is not thus limited, and that other variations, modifications and other embodiments are contemplated as being within the scope of the invention as claimed, and therefore the appended claims are to be construed and interpreted consistent therewith, as encompassing all such other variations, modifications, and additional embodiments, within its intended spirit and scope.

I claim:

1. A cutter device comprising:

a rigid rectangular support frame, including an elongate guide bar for positioning the frame at the edge of a web article;

a transversely extending slide bar joined to and extending across a midportion of the rigid rectangular support frame, being vertically adjustably secured to the elongate guide bar; and a knife holder assembly which is transversely slidable on the transversely extending slide bar, said knife holder assembly comprising a main body member which is transversely slidable on the transversely extending slide bar, means for locking the main body member of the knife holder assembly in a selected transverse position, and means for securing a knife blade on the main body member for engagement with a transversely inward region of the web article, whereby the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

2. A cutter device according to claim 1, wherein the blade holder assembly comprises a main body portion having pivotally mounted thereon a thumb lever, a biasing means for biasedly positioning the thumb lever in a position compressively retaining the knife blade in a selected position, and the thumb lever being manually translatable to release the knife blade from compressive retention by the thumb lever so that the knife blade is selectively manually moveable to a desired position.

3. A cutter device according to claim 2, wherein the blade holder assembly comprises a channel structure in which said knife blade is (I) compressively retained by the thumb lever in the selected position when the thumb lever is biasedly positioned, and (II) slidably selectively moveable when the thumb lever is manually translated to release the knife blade from said compressive retention thereof.

4. A cutter device according to claim 1, wherein the slide bar comprise a transversely extending slot opening therethrough with a mechanical fastener engaging the slot and coupling the blade holder assembly to the slide bar.

5. A cutter device according to claim 1, wherein the slide bar comprises a frontal web-engaging surface portion on a bottom frontal part thereof, and a rear web-engaging surface portion on a bottom rear part thereof.

6. A cutter device according to claim 1, wherein the slide bar comprises on a rear top surface thereof a width indicating means.

7. A cutter device according to claim 1, wherein said rectangular frame comprises a front transversely extending stabilizer bar and a rear transversely extending stabilizer bar, longitudinally spaced from and in parallel relationship to one another.

8. A cutter device according to claim 1, wherein said rectangular frame comprises a ride bar having a height which is less than the height of the guide bar, transversely spaced from and parallel to the guide bar.

9. A cutter device according to claim 7, wherein said rectangular frame comprises a ride bar having a height which is less than the height of the guide bar, transversely spaced from and parallel to the guide bar.

10. A cutter device according to claim 8, wherein the guide bar and ride bar each comprise a vertically upwardly extending elongate plate member, and the rectangular frame comprises a front transversely extending stabilizer bar and a rear transversely extending stabilizer bar, longitudinally spaced from and in parallel relationship to one another, wherein each of the front and rear transversely extending stabilizer bars comprises an elongate cylindrical member.

11. A web cutting kit, including:

a cutter device comprising:

a rigid rectangular support frame, including an elongate guide bar for positioning the frame at the edge of a web article;

a plurality of transversely extending slide bars, each of which is alternatively joinable to the elongate guide bar so as to extend across a midportion of the rigid rectangular support frame, and comprising slide bars of varying length;

a plurality of transversely extending stabilizer bars including pairs of the same length and different pairs being of different lengths, each pair of which is alternatively joinable to the elongate guide bar; and mechanical fasteners for disassembleably interconnecting said guide bar, a pair of said transversely extending stabilizer bars and one of said transversely extending slide bars;

a knife holder assembly which is transversely slidable on the transversely extending slide bar, said knife holder assembly comprising a main body member which is transversely slidable on the transversely extending slide bar, means for locking the main body member of the knife holder assembly in a selected transverse position, and means for securing a knife blade on the main body member for engagement with a transversely inward region of the web article, whereby the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

12. A web cutting kit according to claim 11, further comprising an extension member fixedly securable to the frame member, wherein the extension member comprises an elongate extension arm with a series of longitudinally spaced-apart openings therein for pivotally securing the extension arm for rotation, whereby the cutter device is able to be translated along an arcuate travel path for cutting of a web in a non-linear cut profile.

13. A web cutting kit according to claim 11, wherein the blade holder assembly comprises a main body portion having pivotally mounted thereon a thumb lever, a biasing means for biasedly positioning the thumb lever in a position compressively retaining the knife blade in a selected position, and the thumb lever being manually translatable to release the knife blade from compressive retention by the thumb lever so that the knife blade is selectively manually moveable to a desired position.

14. A cutter device according to claim 13, wherein the blade holder assembly comprises a channel structure in which said knife blade is (I) compressively retained by the thumb lever in the selected position when the thumb lever is biasedly positioned, and (II) slidably selectively moveable when the thumb lever is manually translated to release the knife blade from said compressive retention thereof.

15. A cutter device comprising:

a rigid rectangular support frame, including an elongate guide bar for positioning the frame at the edge of a web article, a ride bar having a height which is less than the height of the guide bar, transversely spaced from and parallel to the guide bar, a front transversely extending stabilizer bar having first and second ends joined to the guide bar and ride bar, respectively, and a rear transversely extending stabilizer bar, having first and second ends joined to the guide bar and ride bar, respectively, longitudinally spaced from and in parallel relationship to one another;

a transversely extending slide bar joined to and extending across a midportion of the rigid rectangular support frame, having first and second ends joined to the guide bar and ride bar, respectively; and a knife holder assembly which is transversely slidable on the transversely extending slide bar, said knife holder assembly comprising a main body member which is transversely slidable on the transversely extending slide bar, means for locking the main body member of the knife holder assembly in a selected transverse position, and means for securing a knife blade on the main body member for engagement with a transversely inward region of the web article, wherein the blade holder assembly comprises a main body portion having pivotally mounted thereon a thumb lever, a biasing means for biasedly positioning the thumb lever in a position compressively retaining the knife blade in a selected position, and the thumb lever being manually translatable to release the knife blade from compressive retention by the thumb lever so that the knife blade is selectively manually moveable to a desired position, wherein the blade holder assembly comprises a channel structure in which said knife blade is (I) compressively retained by the thumb lever in the selected position when the thumb lever is biasedly positioned, and (II) slidably selectively moveable when the thumb lever is manually translated to release the knife blade from said compressive retention thereof, wherein the slide bar comprise a transversely extending slot opening therethrough with a mechanical fastener engaging the slot and coupling the blade holder assembly to the slide bar, whereby the frame member may be translated along the web article with the elongate guide bar in contact with the edge of the web article during such translation, and with the knife blade in cutting engagement with the transversely inward region of the web article, for edge trim removal of a width of the web article to impart thereto a desired width sizing.

16. A cutter device according to claim 15, wherein the slide bar comprises a frontal web-engaging surface portion on a bottom frontal part thereof, and a rear web-engaging surface portion on a bottom rear part thereof.

17. A cutter device according to claim 15, wherein the slide bar comprises on a rear top surface thereof a width indicating means.

18. A cutter device according to claim 15, wherein the guide bar and ride bar each comprise a vertically upwardly extending elongate plate member, and wherein each of the front and rear transversely extending stabilizer bars comprises an elongate cylindrical member.

* * * * *